US006079181A

United States Patent [19]

Ruff

[11] Patent Number: 6,079,181

[45] Date of Patent: Jun. 27, 2000

[54] WALL CONSTRUCTION

[75] Inventor: Robert O. Ruff, Cincinnati, Ohio

[73] Assignee: Ingersoll-Rand Company, Woodcliff Lake, N.J.

[21] Appl. No.: 08/921,210

[22] Filed: Aug. 27, 1997

[51] Int. Cl.[7] ..... E04B 1/16

[52] U.S. Cl. ..... 52/745.15; 52/204.1; 52/656.2; 52/656.6

[58] Field of Search ..... 52/204.1, 205, 52/206, 210, 656.2, 656.6, 667, 668, 745.09, 745.1, 745.15, 745.16; 29/897.15, 897.31, 897.312

[56] References Cited

U.S. PATENT DOCUMENTS

| | | | |
|---|---|---|---|
| 3,008,550 | 11/1961 | Miles et al. | 52/210 |
| 3,195,698 | 7/1965 | Cordea | 52/205 X |
| 3,203,151 | 8/1965 | Bransford, Jr. | 52/205 X |
| 3,504,465 | 4/1970 | Brinker . | |
| 3,593,473 | 7/1971 | King . | |
| 3,811,238 | 5/1974 | Brinker . | |
| 3,961,452 | 6/1976 | Hubbard et al. . | |
| 4,010,671 | 3/1977 | Hubbard et al. . | |
| 4,030,260 | 6/1977 | Sukolics et al. . | |
| 4,141,188 | 2/1979 | Sukolics . | |
| 4,377,926 | 3/1983 | Coulston et al. . | |
| 4,584,804 | 4/1986 | Tajima | 52/668 X |
| 4,750,310 | 6/1988 | Holcombe et al. . | |
| 5,321,924 | 6/1994 | Smolik | 52/204.1 |
| 5,581,953 | 12/1996 | Ruff . | |

OTHER PUBLICATIONS

Steelcraft Brochure, Sep. 1996.
Steelcraft Standard Steel Doors and Frames Brochure, Aug. 1986.
Steelcraft Window Wall Systems Brochure 1980's.
Republic Coped Corner Frames, Dec. 1987.

*Primary Examiner*—Richard Chilcot
*Attorney, Agent, or Firm*—Michael H. Minns

[57] ABSTRACT

A knockdown unit comprising a framework for holding one or more panels and one or more doors, having two outside vertical jambs; at least one vertical mullion; at least one horizontal frame member; at least one sill frame member; the vertical jambs, the at least one vertical mullion, the at least one sill frame member and the at least one horizontal frame member being connectable at a job site to form the knockdown unit, an upper end of each vertical jamb being connected to the at least one horizontal frame member, a lower end of one vertical jamb being connected to a sill frame member, a lower end of the at least one vertical mullion being connected to at least one sill frame member, an upper end of the at least one vertical mullion being connected to the at least one horizontal frame member.

13 Claims, 7 Drawing Sheets

WALL CONSTRUCTION

BACKGROUND OF THE INVENTION

This invention relates generally to wall and door constructions and more particularly to knockdown wall and door constructions.

Typical wall and door constructions are built as a permanent wall. In the event that it becomes necessary to rearrange the walls and doors or is necessary to move equipment which is larger than the door opening, the wall and door constructions must be torn down and later rebuilt.

Knockdown window wall units are generally made of extruded aluminum. Extruded aluminum can be easily milled and fit together as knockdown frame parts. Steel is more involved as it requires notching the sheet in the flat before forming, etc., for the knockdown connections.

The foregoing illustrates limitations known to exist in present wall and door constructions. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a knockdown unit comprising a framework for holding one or more panels and one or more doors, comprising: two outside vertical jambs; at least one vertical mullion; at least one horizontal frame member; at least one sill frame member; the vertical jambs, the at least one vertical mullion, the at least one sill frame member and the at least one horizontal frame member being connectable at a job site to form the knockdown unit, an upper end of each vertical jamb being connected to the at least one horizontal frame member, a lower end of one vertical jamb being connected to a sill frame member, a lower end of the at least one vertical mullion being connected to at least one sill frame member, an upper end of the at least one vertical mullion being connected to the at least one horizontal frame member.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
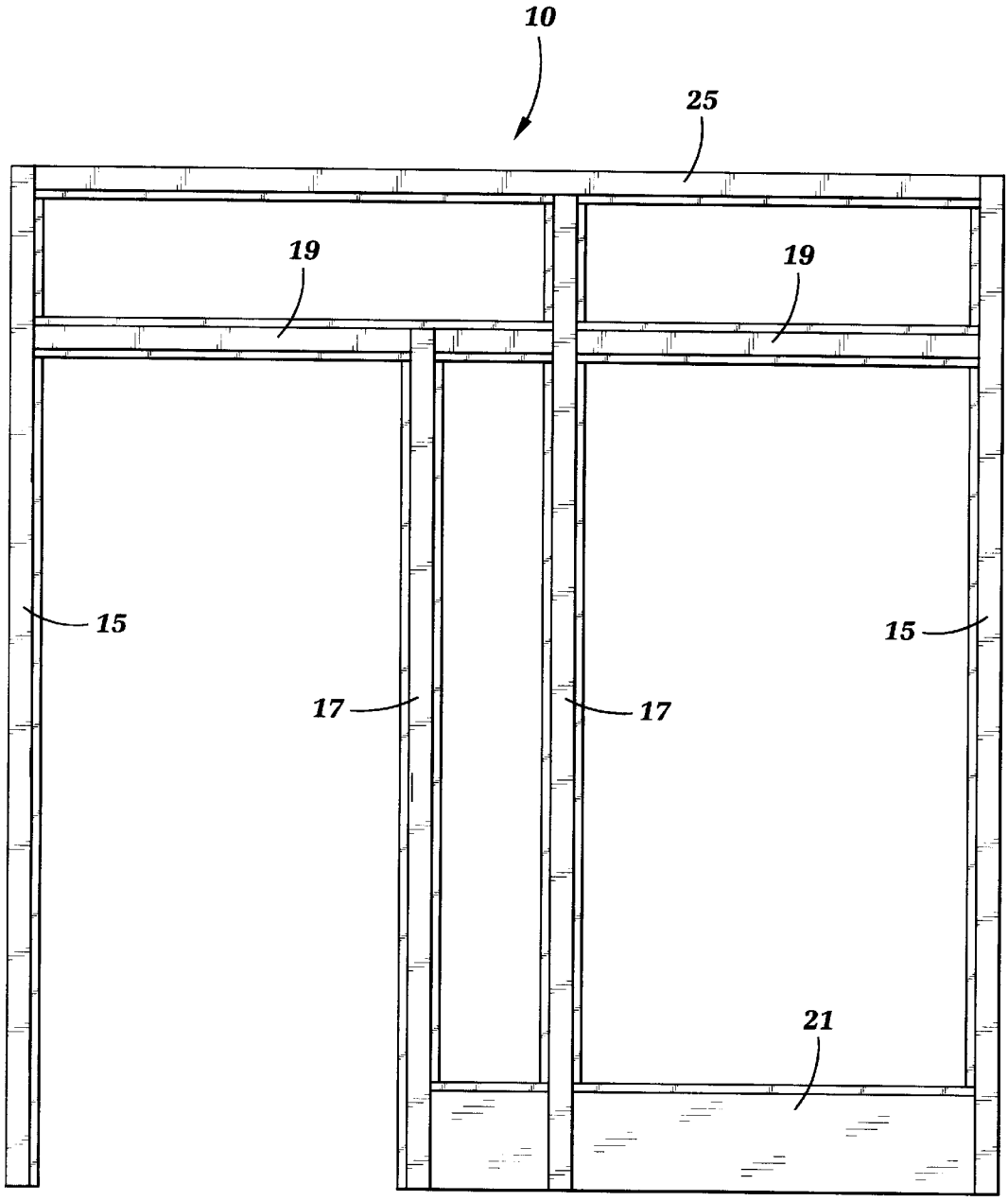
FIG. 1 is a front view of a knockdown unit.
Figure 2:
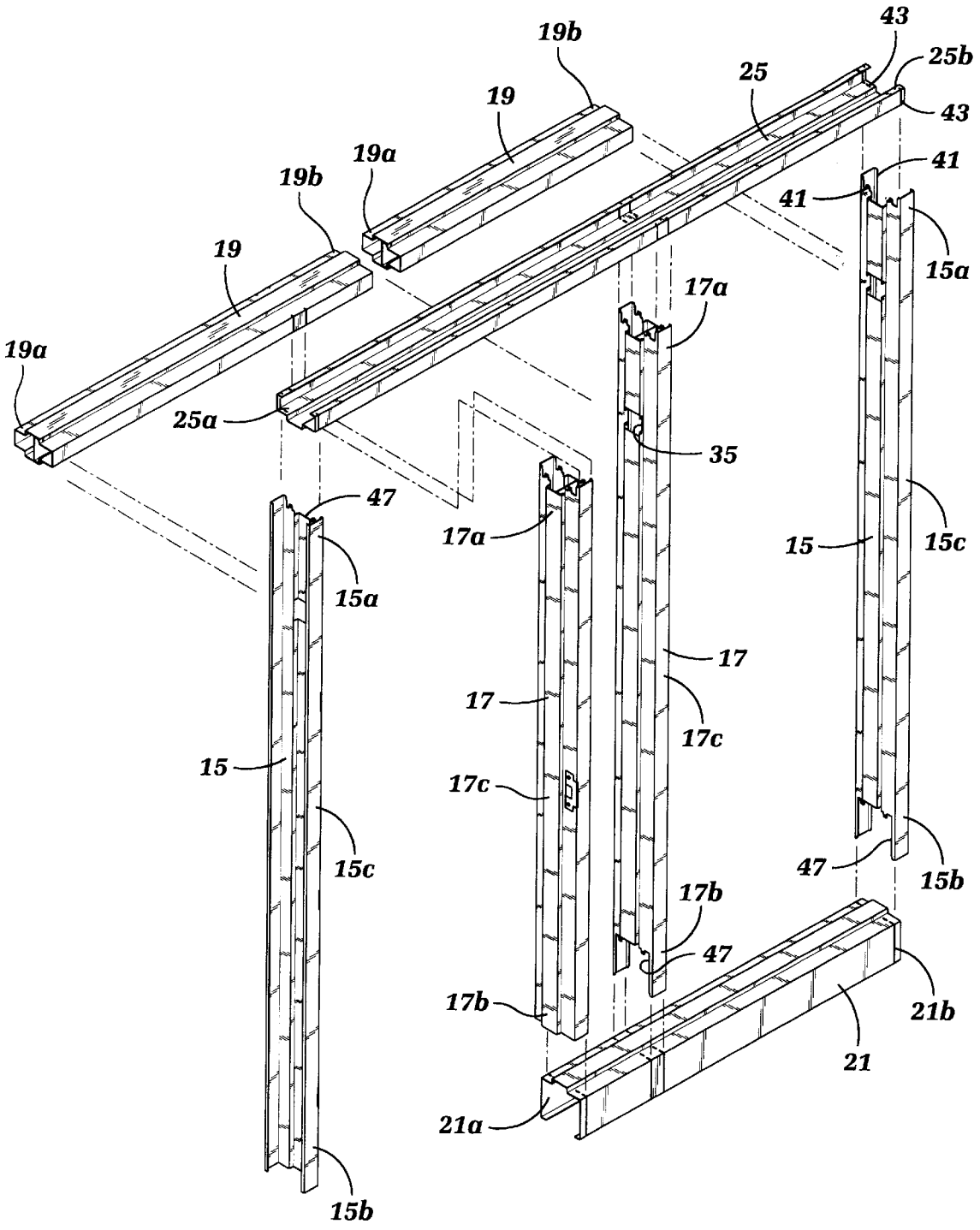
FIG. 2 is an exploded perspective of the knockdown unit shown in FIG. 1.

FIGS. 1 and 2 show a typical knockdown unit 10 comprised of a plurality of frame members, 15, 17, 19, 21, 25 assembled to form a wall and door unit for holding a plurality of doors, windows and panels (not shown). Typically, the knockdown unit 10 includes two vertical jambs 15 which are attached to surrounding walls. Either or both of the vertical jambs can be replaced with vertical mullions (such as vertical mullion 17) where one or both sides of the knockdown unit 10 is attached to another knockdown unit 10 rather than to surrounding walls. The vertical jambs 15 each have atop end 15*a*, a bottom end 15*b*, and an intermediate portion 15*c* therebetween. The vertical mullions 17 each have a top end 17*a*, a bottom end 17*b*, and an intermediate portion 17*c* therebetween. A head frame 25 connects the vertical jambs 15. Preferably, the knockdown unit 10 is formed of steel.

As shown in FIGS. 1 and 2, at least one vertical jamb 15 is connected to a sill frame 21. For knockdown units which do not contain a door, the sill frame 21 would extend from one vertical jamb 15 to the other vertical jamb 15 and both vertical jambs would be connected to the sill frame 21. In the event the door is located in the middle of the knockdown unit, two sill frames 21 are used with each sill frame 21 being connected to a vertical jamb and to a vertical mullion 17.

One or more horizontal mullions 19 can be used in addition to the vertical jambs 15, vertical mullions 17, sill frame 21 and head frame 25 to define door, window or panel enclosures for holding doors, windows or panels (not shown) within the knockdown unit 10. The head frame 25 and sill frame 21 and horizontal mullions 19 each have a first end 25*a*, 21*a*, 19*a* and a second end 25*b*, 21*b*, 19*b*, respectively. Depending on the size of the enclosures and the number of desired doors, windows and panels, the vertical mullions 17 can be shorter, as shown for the leftmost vertical mullion in FIGS. 1 and 2, or longer as shown for the rightmost vertical mullion 17. In the event the longer vertical mullion 17 is used, any horizontal mullions 19 will need to be formed of a plurality of mullions as shown in FIGS. 1, 2 and 8.

Figure 3:
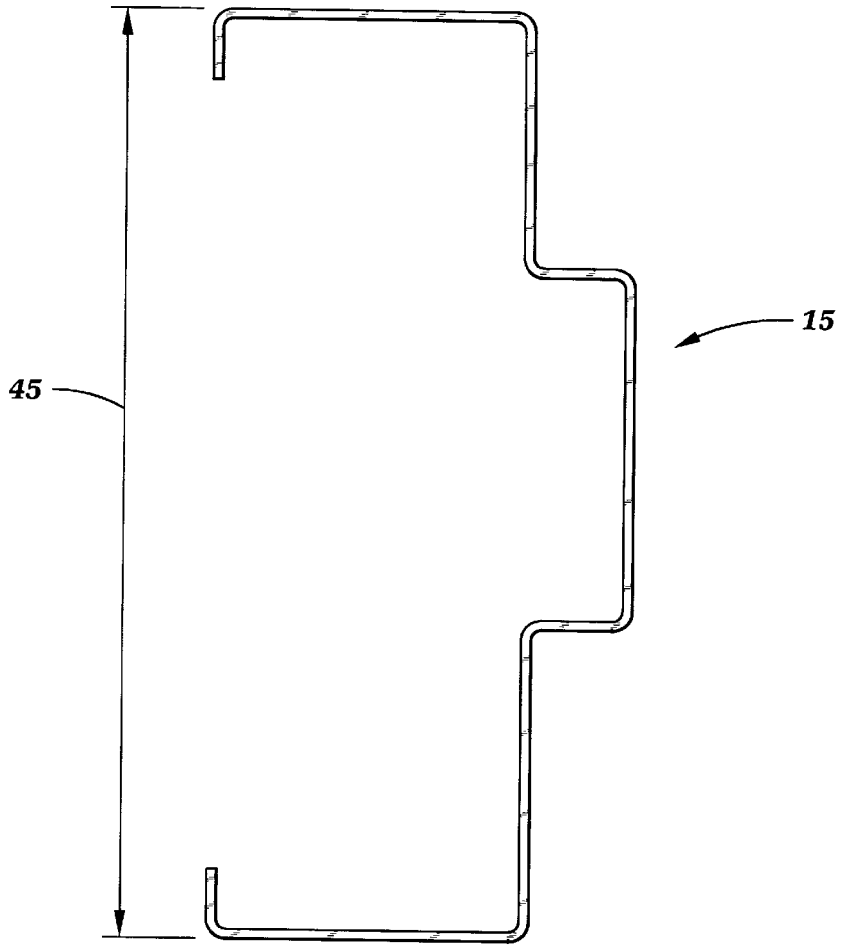
FIG. 3 is a cross-section of a jamb.
Figure 4:
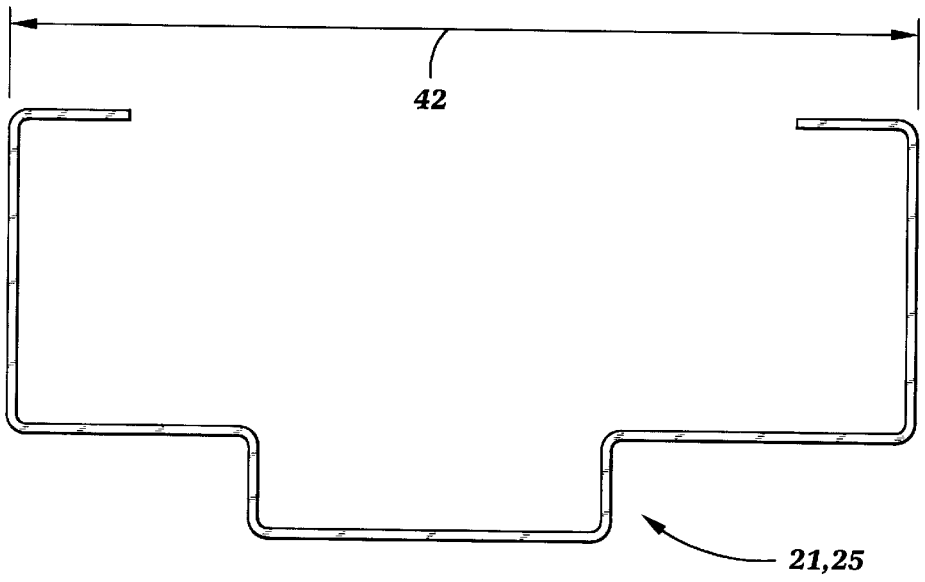
FIG. 4 is a cross-section of a header or sill.
Figure 5:
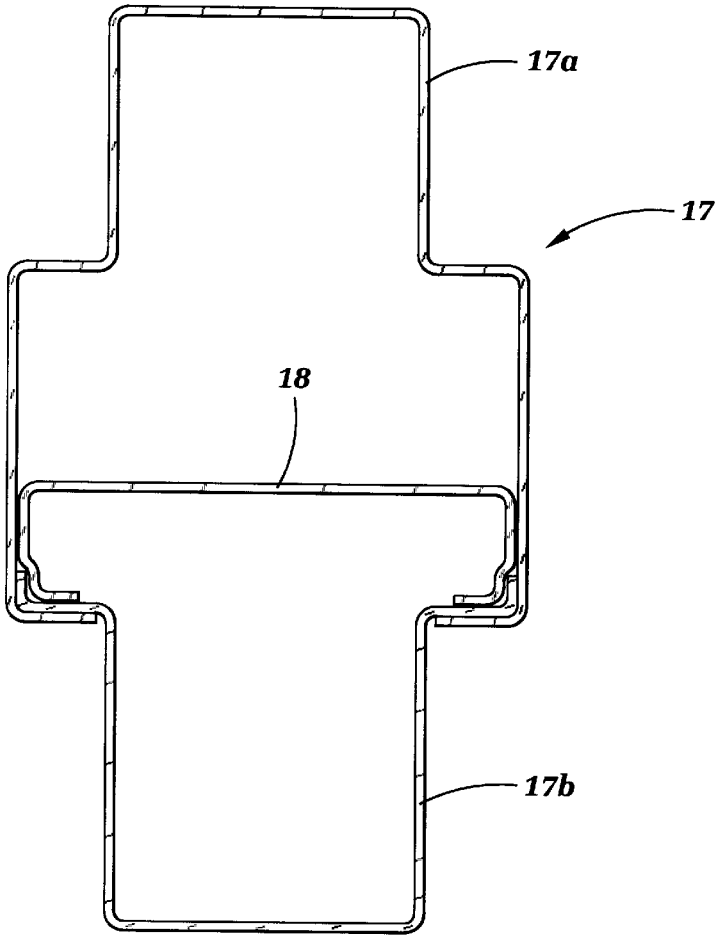
FIG. 5 is a cross-section of a vertical mullion.
Figure 6:
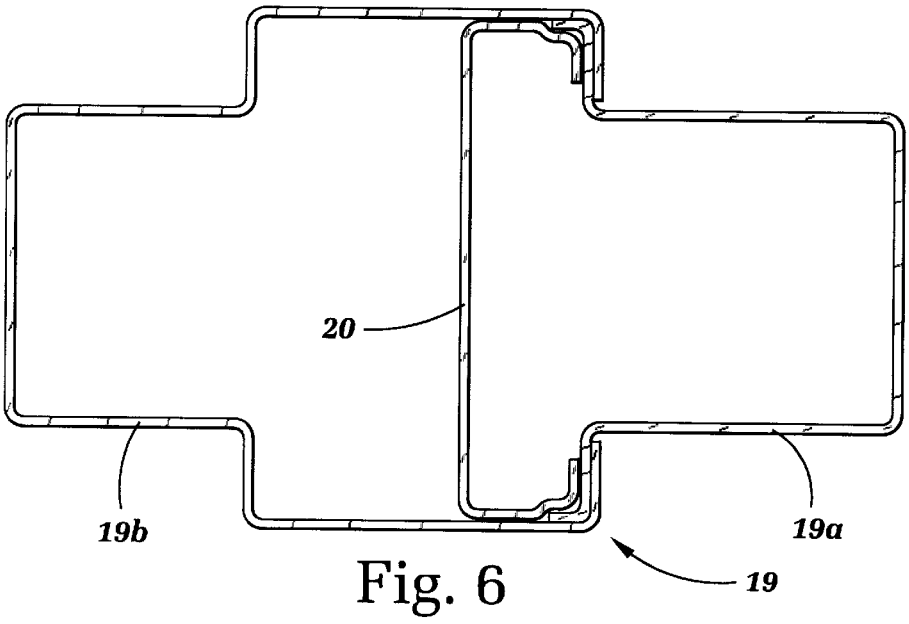
FIG. 6 is a cross-section of a horizontal mullion.

Cross-sections of the vertical jamb 15 and sill frame and head frame 21, 25 are shown in FIGS. 3 and 4. The width 42 of the sill frame 21 and head frame 25 is slightly smaller (by about two thicknesses of the sheet metal) than the width 45 of the vertical jamb 15 (and also the corresponding width of the vertical mullion 17). This is to allow, for example, the head frame 25 to fit within the cut-outs 47 in the ends of the vertical jambs 15 and vertical mullions 17. FIGS. 5 and 6 show cross-sections of the vertical mullion 17 and horizontal mullion 19. Each mullion is formed from two main bent sheet metal sections (17*a*, 17*b* and 19*a*, 19*b* respectively) with an internal stiffener (18, 20 respectively). Generally, the stiffeners extend the entire length of a mullion, except where a cut-out (such as at 35) has been made to connect to another mullion.

Figure 7:
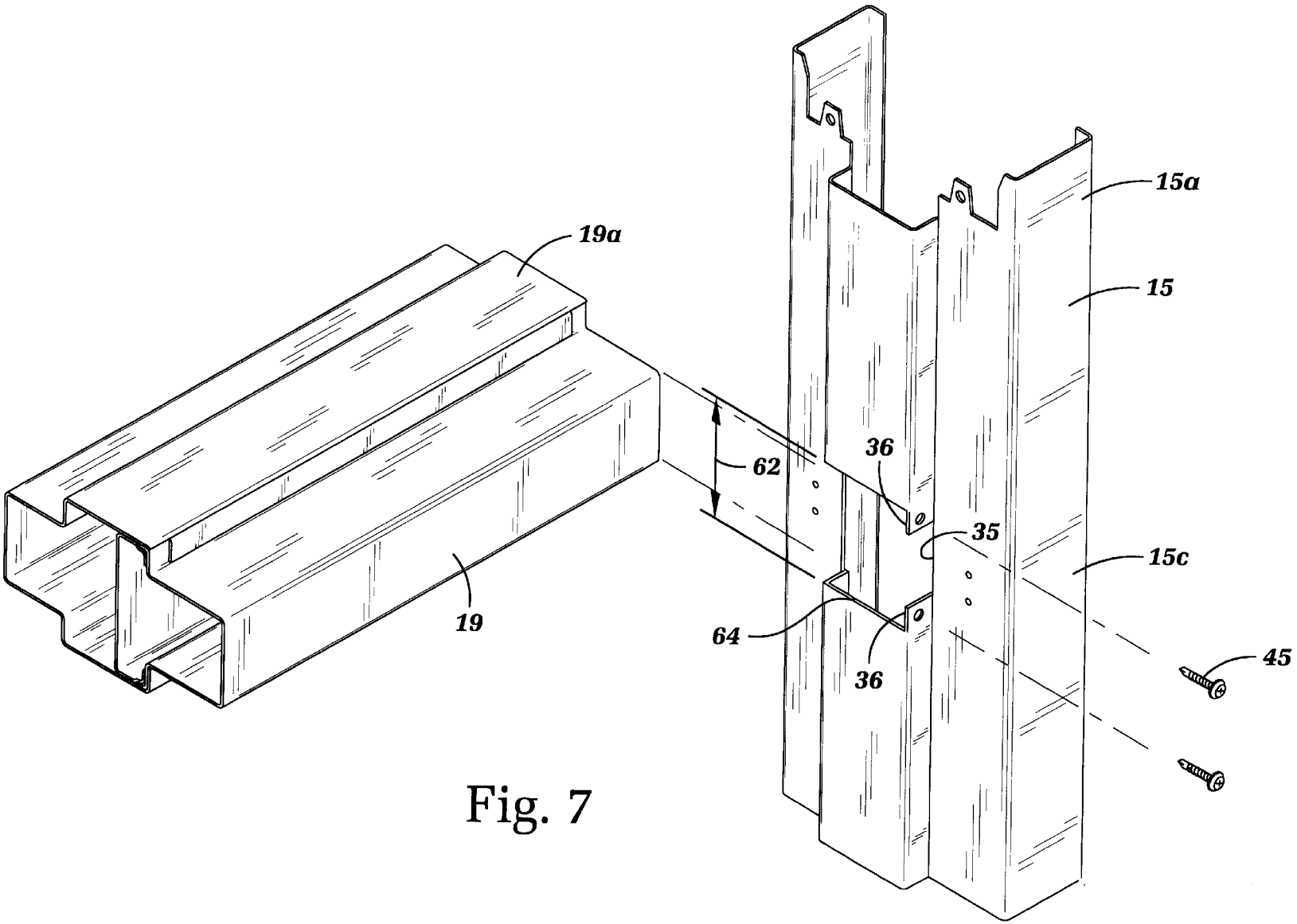
FIG. 7 is an enlarged exploded perspective view showing the details of the horizontal mullion to vertical mullion connection.
Figure 9:
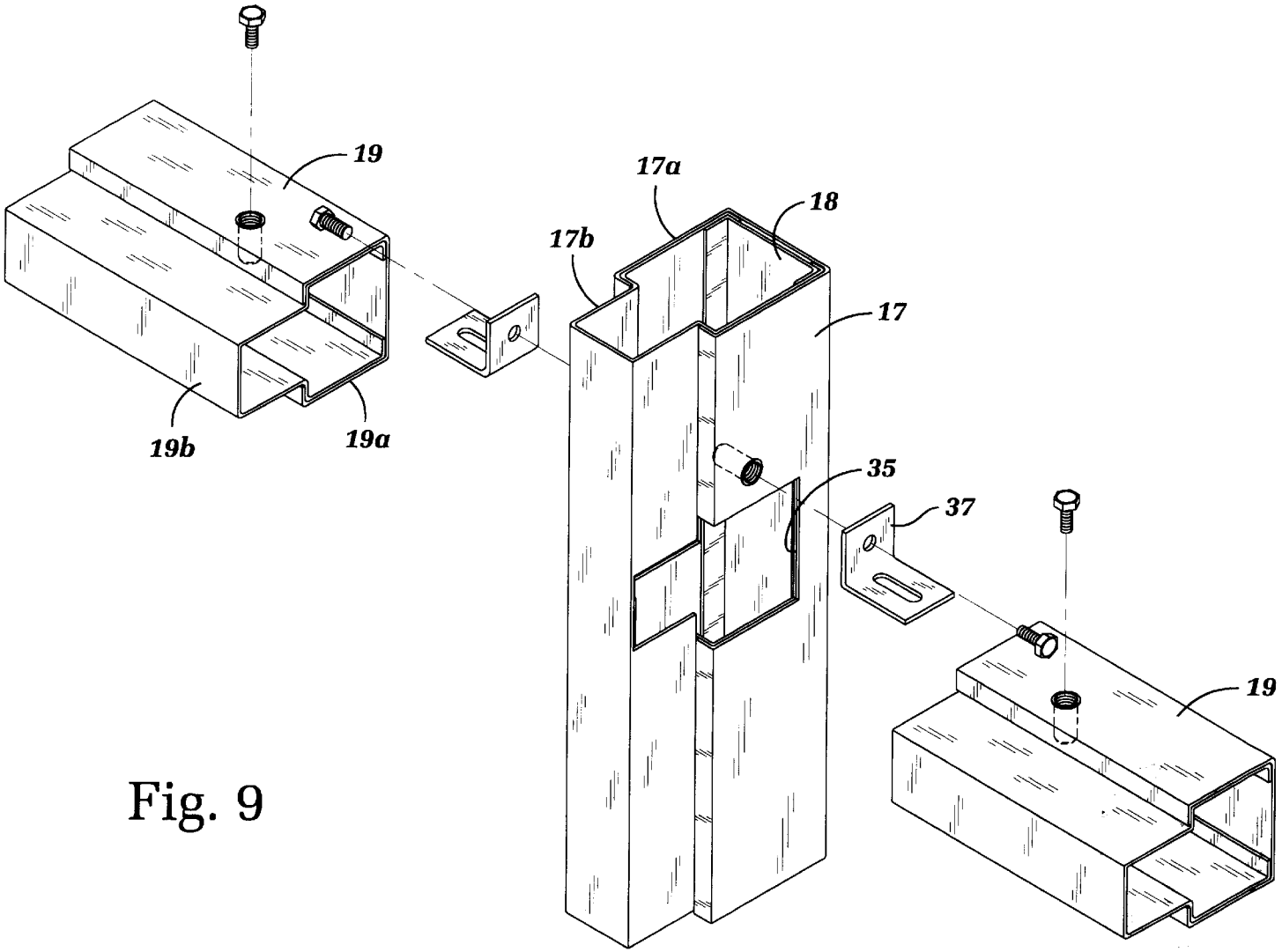
FIG. 9 is an enlarged exploded perspective view showing an alternate embodiment of a horizontal mullion to vertical mullion connection.

FIGS. 7 and 9 illustrate two ways of connecting a horizontal mullion 19 to either a vertical jamb 15 or a vertical mullion 17. Either way could be used for either vertical member. In FIG. 7, the soffit of the vertical jamb 15 contains a cut-out 35 with two depending tabs 36. The horizontal first end 19*a* (or second end 19*b*) of the mullion 19 is slid into an opening 62 of the cut-out 35. Cut-out 35 comprises a lower shelf 64 which provides direct support to the horizontal mullion 19. Removable fasteners such as screws 45 can be inserted through the tabs 36 into the horizontal mullion 19 to attach the horizontal mullion 19 to the vertical jamb 15. In FIG. 9, the sides of vertical mullion 17 contain cut-outs 35 into which the ends of the horizontal mullions 19 are slid. The cut-out 35 provide horizontal support to the horizontal mullions 19. L-shaped brackets 37 and removable fasteners such as screws are used to attach the horizontal mullions 19 to the vertical mullion 17.

Figure 8:
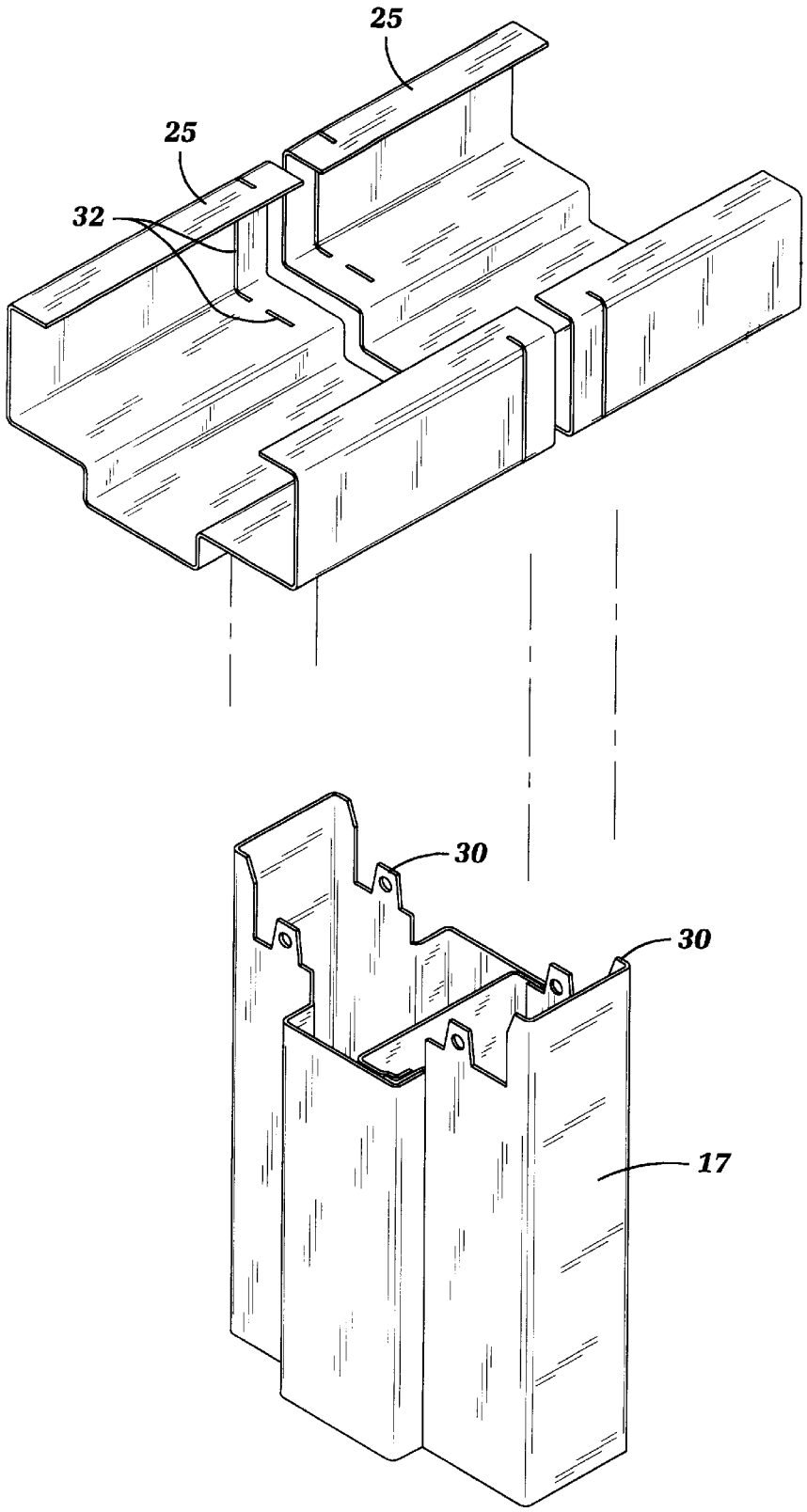
FIG. 8 is an enlarged exploded perspective view showing the details of a two piece header to vertical mullion connection.

FIG. 8 shows a typical connection where the horizontal member rests on the vertical member or the vertical member rests on the horizontal member. The horizontal member, in this case head frame 25, could be two head frame members 25, as shown, or a single head frame member 25, as shown in FIGS. 1 and 2. The vertical mullion 17 contains a plurality of vertically extending tabs 30 which, when assembled, extend into slots 32 in the head frames 25.

To assemble a knockdown unit 10, the unit members including at least two outside vertical jambs 15, at least one vertical mullion 17, a horizontal head frame 25, at least one horizontal sill frame 21, and at least one horizontal mullion 19 are delivered to a job site. The horizontal head frame 25 is slid into a top of a wall opening and is temporarily supported within the top of the opening. The horizontal sill frames 21 are set into a bottom of the opening. The vertical jambs 15 are inserted into the opening, each vertical jamb 15 being adjacent a side of the opening. The top tabs 41, extending from the top of each vertical jamb 15, are inserted into the corresponding slots 43 in the horizontal head frame 25 and the bottom tabs 41 extending from the bottom of the vertical jamb 15 are slid into corresponding slots 43 in the horizontal sill 21. Then the horizontal mullion 19 is slid into cut-outs 35 in either a vertical jamb 15 or a vertical mullion 17 along with installing the vertical mullion 17 into either a horizontal head frame 25 or a horizontal mullion 19. The horizontal mullions 19 are connected to the corresponding vertical jamb 15 or the vertical mullion 19.

Having described the invention, what is claimed is:

1. A method for assembling a knockdown unit, said knockdown unit including at least a first and a second vertical frame member, said vertical frame members consisting of either a vertical jamb or a vertical mullion each having a top end and a bottom end separated by an intermediate portion, and at least two horizontal frame members, said horizontal frame members consisting of at least one horizontal head frame member and at least one horizontal sill frame member each having a first end and a second end, and a horizontal mullion having a first end and a second end, the method comprising the following steps, wherein steps a, b, and c may be completed in any order:

a) attaching the first end of said at least one horizontal head frame member to the top end of said first vertical frame member;

b) attaching the second end of said at least one horizontal head frame member to the top end of said second vertical frame member;

c) attaching said at least one horizontal sill member to said first and second vertical members;

d) sliding the first end of said horizontal mullion into a corresponding cut-out portion of said first vertical frame member, said cut-out being located in the intermediate portion of said vertical frame member, said cut-out having an opening to allow horizontal entry of said mullion into said cut-out and onto a lower shelf for direct support of said first end of said horizontal mullion; and e) sliding the second end of said horizontal mullion into a corresponding cut-out portion of said second vertical frame member, said cut-out being located in the intermediate portion of said vertical frame member, said cut-out having an opening to allow horizontal entry of said mullion into said cut-out and onto a lower shelf for direct support of said first end of said horizontal mullion.

2. The method of claim 1 further including the step of:

registering said first and second ends of said horizontal mullion against at least one vertically extending tab located opposite said opening of said first and second vertical member cut-outs.

3. The method of claim 2 further including the step of:

securing said first and second ends of said horizontal mullion to said at least one vertically extending tab of said first and second vertical member cut-outs.

4. The method of claim 2 further including the step of:

securing said first and second ends of said horizontal mullion to the at least one vertically extending tab of said first and second vertical member cut-outs with at least one screw.

5. The method of claim 2 further including the step of:

welding said first and second ends of said horizontal mullion to the at least one vertically extending tab of said first and second vertical member cut-outs.

6. The method of claim 1 wherein steps d and e are performed simultaneously.

7. A method for assembling a knockdown unit, said knockdown unit including at least a first and a second vertical frame member, said vertical frame members consisting of either a vertical jamb or a vertical mullion each having a top end and a bottom end separated by an intermediate portion, and at least two horizontal frame members, said horizontal frame members consisting of at least one horizontal head frame member and at least one horizontal sill frame member each having a first end and a second end, and a horizontal mullion having a first end and a second end, the method comprising the following steps, wherein steps a, b, and c may be completed in any order:

a) attaching the first end of said at least one horizontal head frame member to the top end of said first vertical frame member;

b) attaching the second end of said at least one horizontal head frame member to the top end of said second vertical frame member;

c) attaching said at least one horizontal sill member to said first and second vertical members;

d) sliding the first end of said horizontal mullion into a corresponding cut-out portion of said first vertical frame member, said cut-out being located in the intermediate portion of said vertical frame member, said cut-out having an opening to allow horizontal entry of said mullion into said cut-out; and e) sliding the second end of said horizontal mullion into a corresponding cut-out portion of said second vertical frame member, said cut-out being located in the intermediate portion of said vertical frame member, said cut-out having an opening to allow horizontal entry of said mullion into said cut-out.

8. The method of claim 7 further including the step of:

supporting said first and second ends of said horizontal mullion directly against a lower shelf of each of said cut-outs.

9. The method of claim 8 further including the step of:

registering said first and second ends of said horizontal mullion against at least one vertically extending tab opposite said opening of said cut-out portion in each of said vertical members.

10. The method of claim 9 further including the step of:

securing said first and second ends of said horizontal mullion to the at least one vertically extending tab of said first and second vertical member cut-outs.

11. The method of claim 9 further including the step of:

securing said first and second ends of said horizontal mullion to the at least one vertically extending tab of the cut-out portion in each of said vertical members with at least one screw.

12. The method of claim 9 further including the step of:

welding said first and second ends of said horizontal mullion to the at least one vertically extending tab of the cut-out portion in each of said vertical members.

13. The method of claim 7, wherein steps d and e are performed simultaneously.

* * * * *